US007347809B2

(12) United States Patent
Toth

(10) Patent No.: US 7,347,809 B2
(45) Date of Patent: Mar. 25, 2008

(54) COMPACT APPARATUS AND SYSTEM FOR CREATING AND DISPENSING CUSHIONING DUNNAGE

(75) Inventor: Zsolt Toth, Tuckahoe, NY (US)

(73) Assignee: Zsolt Design Engineering, Inc., Tuckahoe, NY (US)

( * ) Notice: Subject to any disclaimer, the term of this patent is extended or adjusted under 35 U.S.C. 154(b) by 0 days.

(21) Appl. No.: 11/640,846

(22) Filed: Dec. 19, 2006

(65) Prior Publication Data

US 2007/0117704 A1 May 24, 2007

Related U.S. Application Data

(60) Division of application No. 10/647,252, filed on Aug. 26, 2003, now Pat. No. 7,163,503, which is a division of application No. 10/208,772, filed on Aug. 1, 2002, now Pat. No. 6,673,001, which is a continuation-in-part of application No. 09/819,998, filed on Mar. 29, 2001, now Pat. No. 6,503,182.

(51) Int. Cl.
*B31B 1/14* (2006.01)

(52) U.S. Cl. ..... 493/365; 493/464; 493/967

(58) Field of Classification Search ..... 493/233, 493/234, 235, 238, 352, 363, 364, 365, 370, 493/464, 967; 53/390; 83/491, 492, 495
See application file for complete search history.

(56) References Cited

U.S. PATENT DOCUMENTS

| | | | | |
|---|---|---|---|---|
| 673,312 | A | 4/1901 | Bechman | 493/370 |
| 803,972 | A | 11/1905 | Bechman | 493/370 |
| 1,739,328 | A | 12/1929 | Roesen | 493/370 |
| 2,786,399 | A | 3/1957 | Mason et al. | 493/967 |
| 3,473,291 | A | 10/1969 | Raumond et al. | 53/530 |
| 3,522,762 | A * | 8/1970 | Sauer | 493/365 |
| 3,603,216 | A | 9/1971 | Johnson | 493/967 |
| 3,613,528 | A * | 10/1971 | Vermes | 493/363 |
| 3,799,039 | A | 3/1974 | Johnson | 493/967 |
| 4,052,920 | A | 10/1977 | Dixon | 83/337 |
| 4,355,493 | A | 10/1982 | Ellert | 53/530 |
| 4,750,896 | A | 6/1988 | Komaransky et al. | 493/967 |
| 4,999,968 | A | 3/1991 | Davis | 493/238 |
| 5,076,555 | A | 12/1991 | Bunch, Jr. | 493/415 |
| 5,131,903 | A | 7/1992 | Levine et al. | 493/464 |
| 5,203,761 | A | 4/1993 | Reichental et al. | 493/967 |

(Continued)

*Primary Examiner*—Louis Huynh
(74) *Attorney, Agent, or Firm*—Antonelli, Terry, Stout & Kraus, LLP.

(57) ABSTRACT

A system for creating and dispensing cushioning dunnage is small and permits flexible installation configuration options for a single or multiple packing stations. A compact apparatus of the system is capable of being pivotally mounted as a unit on a stand and includes a motor and a material feeding arrangement driven by the motor for pulling material from a supply roll of the material supported on a stand of the system, and feeding it through the apparatus. A plurality of material shaping members upstream of the feeding arrangement shape the material in the apparatus to convert it into a continuous strip of cushioning product. The feeding arrangement in one embodiment includes cooperating feed rollers, at least one of which is a rotary cutting die having a plurality of cutting blades on its surface for cutting slits in the material at spaced locations along the length of the material to allow an operator to manually rip a desired length of cushioning product from the material being dispensed from the apparatus.

2 Claims, 19 Drawing Sheets

U.S. PATENT DOCUMENTS

| | | | | |
|---|---|---|---|---|
| 5,643,647 | A | 7/1997 | Wischusen, III | |
| 5,730,696 | A | 3/1998 | Simmons | 493/967 |
| 5,749,539 | A | 5/1998 | Ratzel et al. | |
| 5,755,656 | A | 5/1998 | Beierlorzer | 493/967 |
| 5,785,639 | A | 7/1998 | Simmons | |
| 5,902,223 | A | 5/1999 | Simmons | 493/967 |
| 5,938,580 | A | 8/1999 | Siekmann | |
| 6,033,353 | A | 3/2000 | Lencoski et al. | 493/464 |
| 6,146,321 | A | 11/2000 | Simmons | 493/967 |
| 6,179,765 | B1 | 1/2001 | Toth | |
| 6,200,251 | B1 | 3/2001 | Harding et al. | 493/464 |
| 6,217,501 | B1 | 4/2001 | Simmons et al. | 493/967 |
| 6,240,705 | B1 | 6/2001 | Simmons et al. | 493/967 |
| 6,277,459 | B1 | 8/2001 | Lencoski et al. | 493/967 |

* cited by examiner

COMPACT APPARATUS AND SYSTEM FOR CREATING AND DISPENSING CUSHIONING DUNNAGE

RELATED APPLICATIONS

This application is a Divisional of U.S. Ser. No. 10/647,252, filed Aug. 26, 2003, now U.S. Pat. No. 7,163,503 issued Jan. 16, 2007, which is a Divisional of U.S. Ser. No. 10/208,772, filed Aug. 1, 2002, now U.S. Pat. No. 6,673,001, which is a Continuation-in-Part of U.S. application Ser. No. 09/819,998, filed Mar. 29, 2001, now U.S. Pat. No. 6,503,182 issued Jan. 7, 2003, which is hereby incorporated by reference. Commonly owned U.S. patent application Ser. No. 09/819,640, filed Mar. 29, 2001, and now U.S. Pat. No. 6,471,154 issued Oct. 29, 2002, for Automatic Roll Tensioner and Material Dispensing System Using the Same, is also hereby incorporated by reference.

TECHNICAL FIELD

The invention relates to an apparatus and a system employing the same for creating and dispensing material for use as void fill and cushioning dunnage in the packaging industry when shipping products in boxes, for example.

BACKGROUND

Cushioning dunnage is used as a protective packaging material when shipping an item in a container. The dunnage fills any voids and/or cushions the item in the container during shipping. Typical materials for forming cushioning dunnage include paper and plastic. Relatively complicated machines and methods are known for producing cushioning dunnage comprising resilient pillow-like strips from rolls of stock material. One such known machine is disclosed in U.S. Pat. No. 5,785,639. The known machines are disadvantageous in that they are suitable primarily for larger-scale productions and they are relatively expensive. There has long been a need in the packaging industry for a small and inexpensive device that creates and dispenses paper or other material for use as void fill and cushioning when shipping products in boxes or other containers.

SUMMARY

The present invention addresses this need in providing a compact apparatus and a system employing the apparatus for creating and dispensing cushioning dunnage. The apparatus and system are capable of meeting the needs of both ends of the customer spectrum. Namely, the compact apparatus and system of the invention are affordable and practical for a customer whose packing needs can be met with a single unit that does not take up a lot of space. The apparatus and system can also serve the needs of customers with high-speed and high-volume production lines having multiple, stand alone packing stations and/or centralized packing stations.

A compact apparatus according to the invention for creating and dispensing material for use as void fill and cushioning dunnage is small enough that it is capable of being mounted as a unit on a stand. The compact apparatus or head comprises a motor and a material feeding arrangement driven by the motor for pulling material from a supply of material and feeding it through the apparatus where it is converted into a cushioning product. A plurality of material shaping members upstream of the material feeding arrangement in the compact apparatus shape the material to convert it into a continuous strip of cushioning product as the material is fed through the apparatus. In one embodiment, a perforator driven by the motor perforates the material at spaced locations along the length of the material as the material is fed through the apparatus to allow an operator to rip from the apparatus a desired length of cushioning product being dispensed by the apparatus. According to a second embodiment, in the compact apparatus operating feed rollers, at least one of which is a rotary cutting die, are used to feed and slit the material for creating and dispensing void fill and cushioning dunnage.

A system of the invention for creating and dispensing material for use as void fill and cushioning dunnage includes the aforementioned compact apparatus and a stand on which the compact apparatus is mounted. According to an example embodiment, the compact apparatus is pivotally mounted on the stand to facilitate material loading. In one form of the invention, the stand is a material cart with wheels, the material cart including a support for rotatably supporting a roll of material which is to be pulled from the roll and supplied to the compact apparatus. An automatic roll tensioner for tensioning material being pulled from the roll maintains tension on the material even when pulling suddenly stops. The cart can also include a work surface for an operator handling cushioning product dispensed by the compact apparatus. As a further feature of the invention, an overhead delivery system is provided for delivering rolls of material to the roll support of a system where the roll support is elevated above an adjacent work surface for an operator handling cushioning product dispensed by the compact apparatus.

These and other features and advantages of the present invention will become more apparent from the following description when taken in connection with the accompanying drawings which show, for purposes of illustration only, several example embodiments in accordance with the present invention.

BRIEF DESCRIPTION OF DRAWINGS

The following represents brief descriptions of the drawings, wherein.

DETAILED DESCRIPTION

Figure 1:
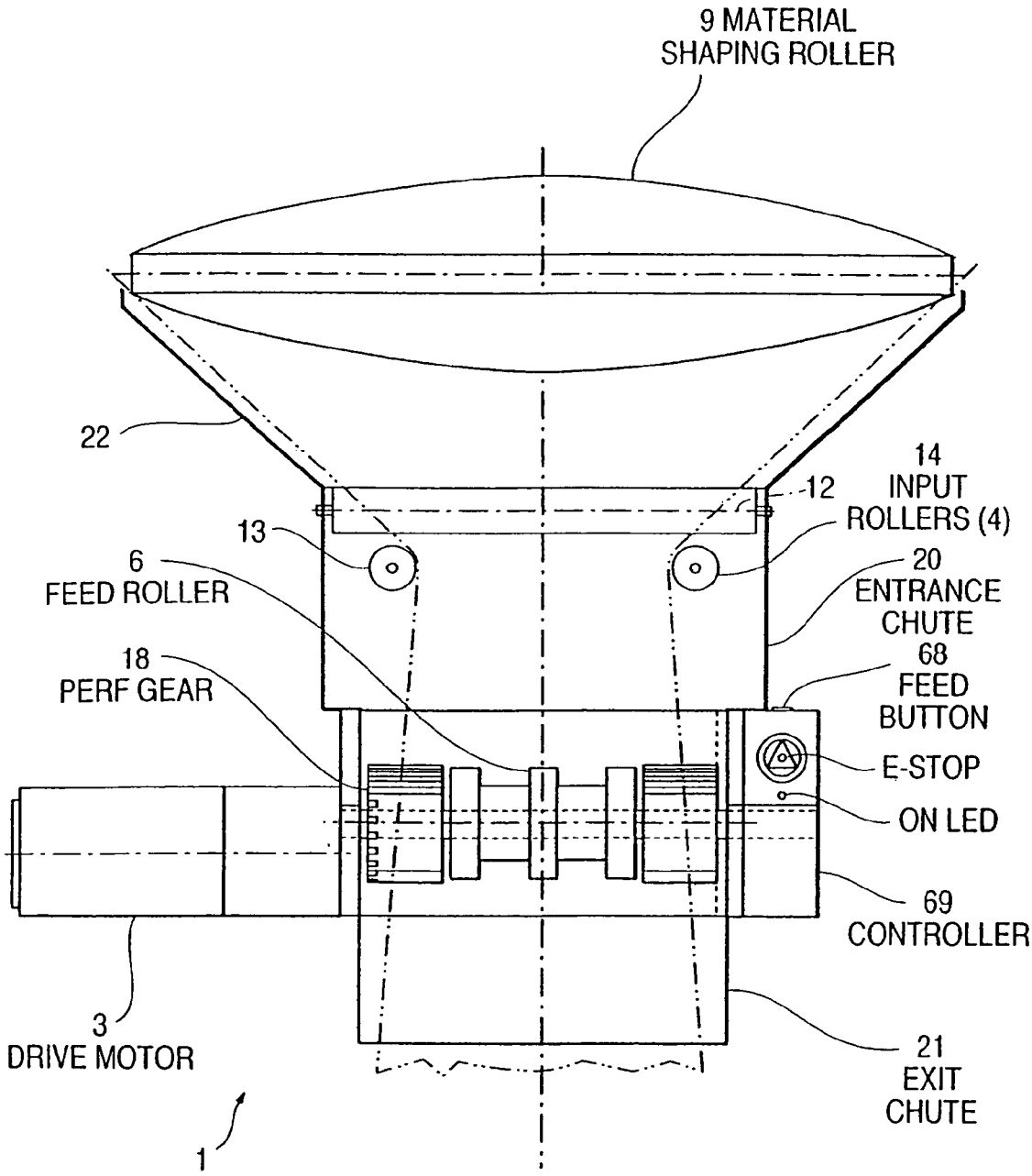
FIG. 1 is a front side view of a compact apparatus according to an example embodiment of the invention for creating and dispensing material for use as void fill and cushioning dunnage.
Figure 2:
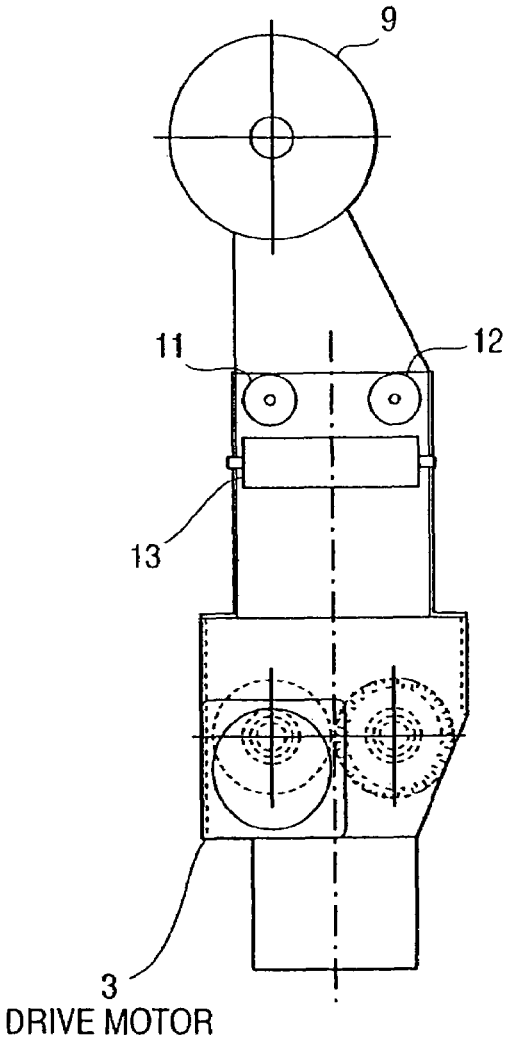
FIG. 2 is a left side view of the compact apparatus of FIG. 1.
Figure 3:
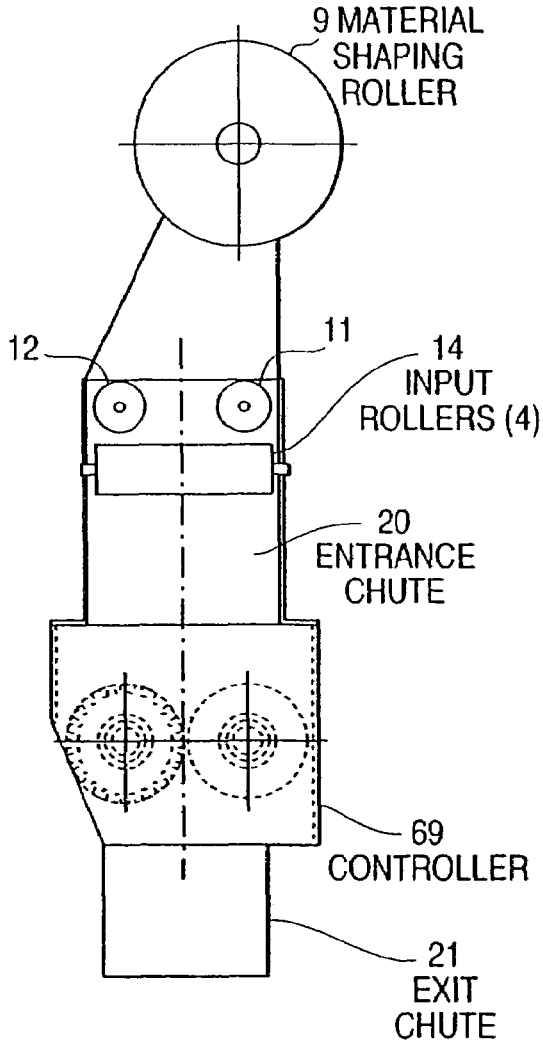
FIG. 3 is a right side view of the compact apparatus of FIG. 1.

Referring now to the drawings, a compact apparatus 1 of the invention, as shown in FIGS. 1-6, is for creating and dispensing material for use as a void fill and cushioning dunnage. The apparatus 1 is a relatively small, integral unit capable of being mounted on a stand, for example, floor stand 2 in FIG. 6. The apparatus 1 comprises a motor 3 and a material feeding arrangement 4, FIG. 4, driven by the motor for pulling material from a supply of material, e.g., a material roll 5 in FIG. 6, and feeding it through the apparatus.

Figure 4:
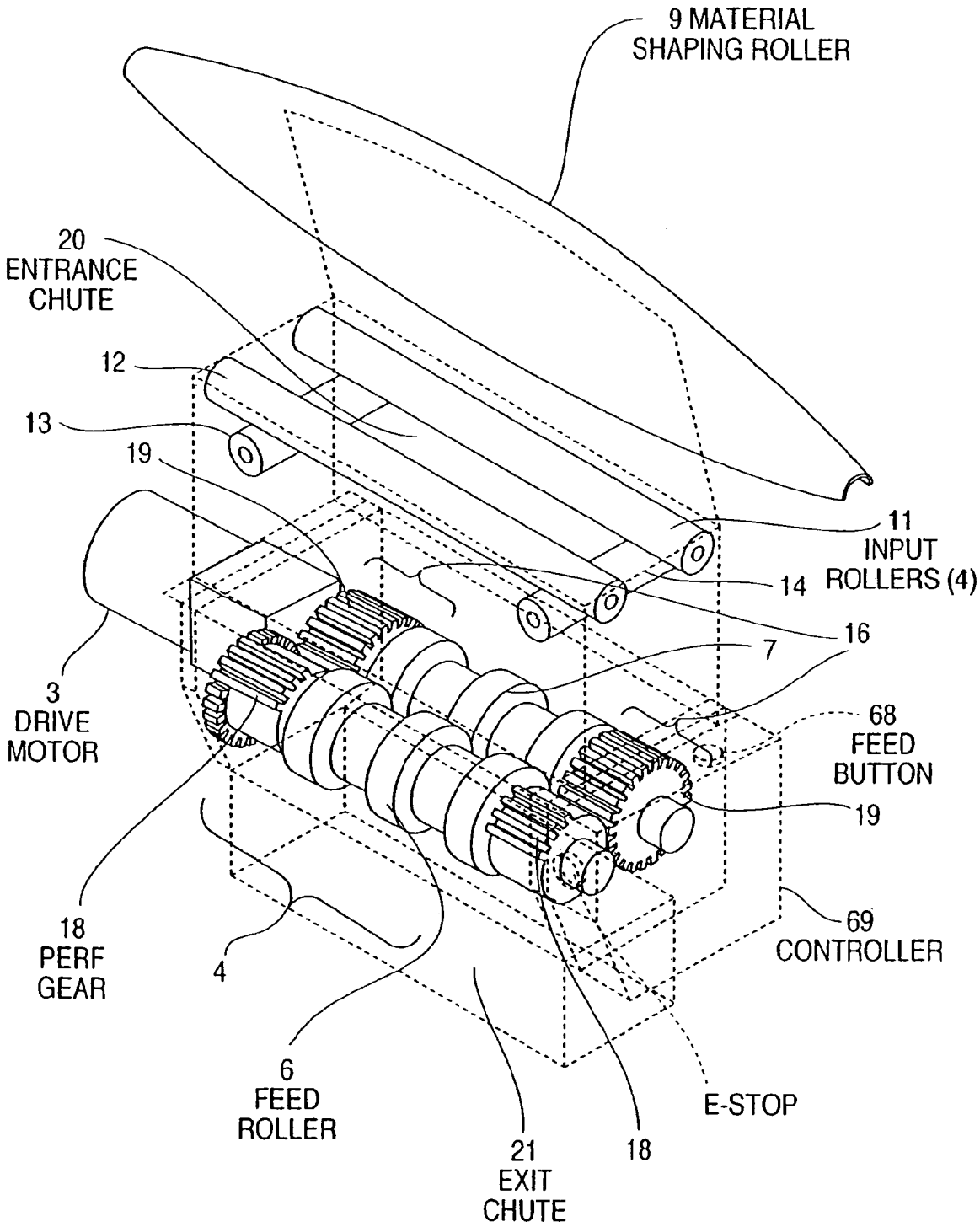
FIG. 4 is a schematic drawing of functional components of the compact apparatus of FIGS. 1-3 more clearly showing the components.
Figure 5:
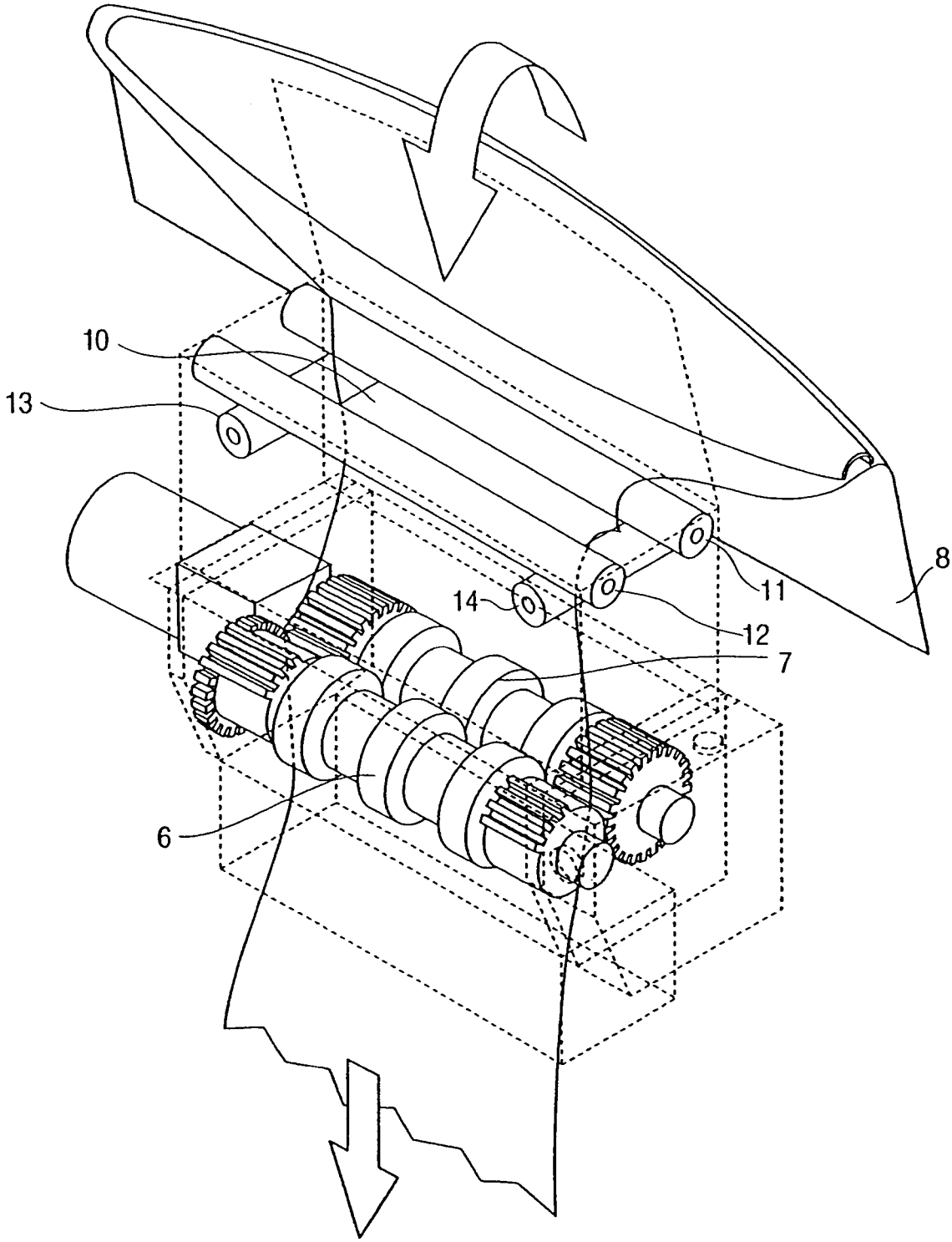
FIG. 5 is a schematic drawing like FIG. 4 showing the apparatus functional components in relation to a paper material being pulled into the apparatus from a supply roll of the paper and fed through the apparatus while being converted into a cushioning product.
Figure 7A:
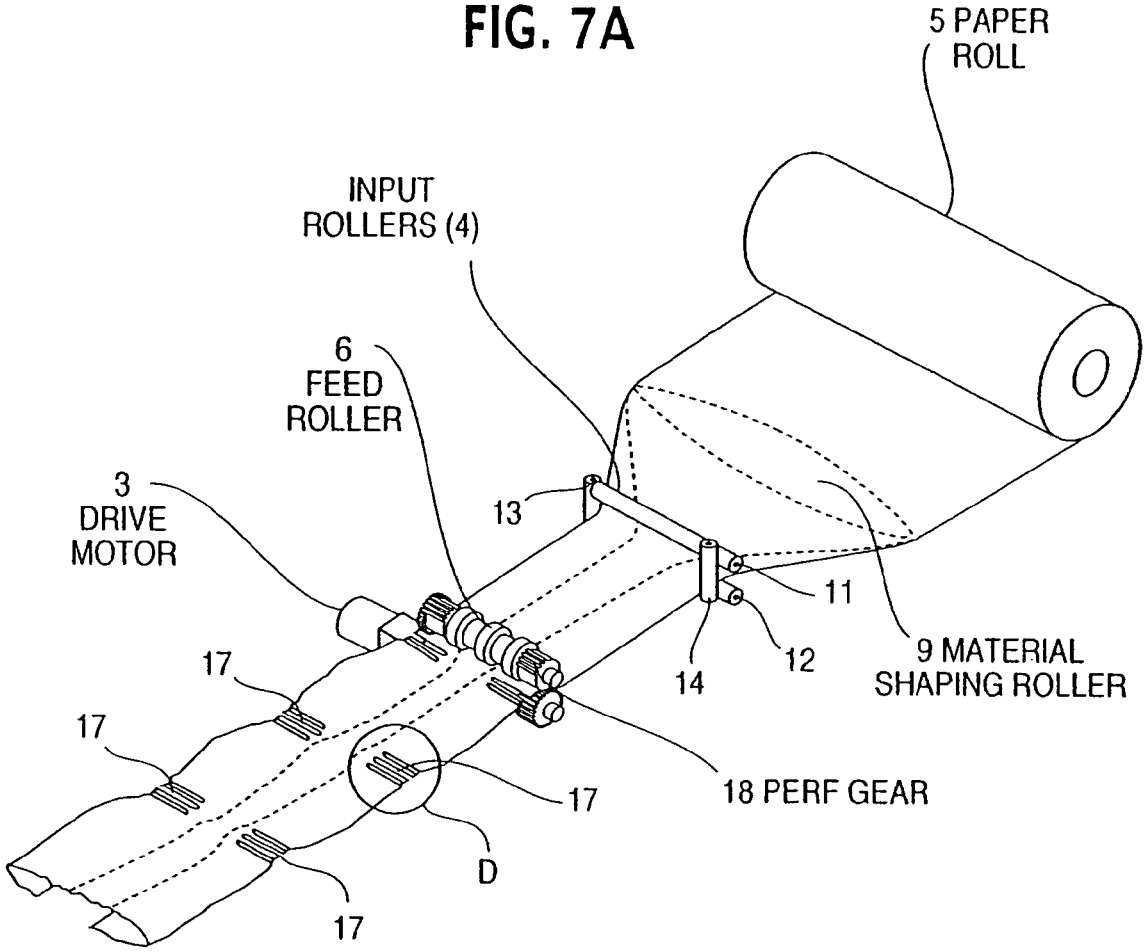
FIG. 7A is a view similar to FIG. 5 but showing more details of the pillow-like product formed by the apparatus with spaced perforations along the length of the product enabling an operator to tear off in a predictable way a desired length of the material from the continuous strip dispensed from the apparatus.
Figure 7B:
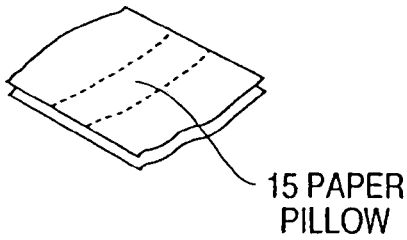
FIG. 7B is a perspective view from above and to one side of a paper pillow which has been ripped from the free end of the continuous cushioning product shown in FIG. 7A.
Figure 7C:
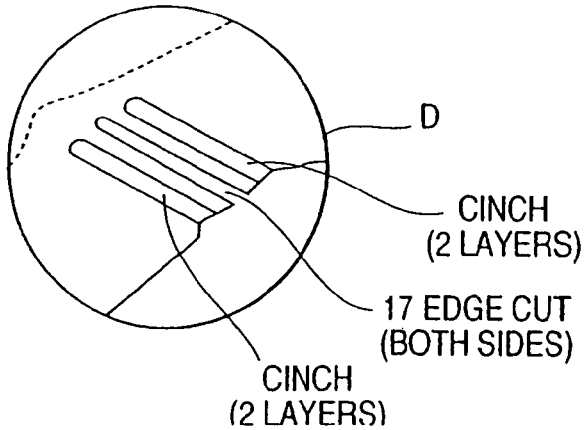
FIG. 7C is an enlarged view of the portion of the cushioning product within the circle D in FIG. 7A, illustrating a perforated area along one edge of the cushioning product.

The material feeding arrangement 4 comprises cooperating feed rollers 6 and 7, see FIG. 4, between which the material 8, paper in the example embodiment, is fed as depicted in FIG. 5. A plurality of material shaping members upstream of the material feeding arrangement 4 shape the material 8 into a continuous strip of cushioning product as the material is fed through the apparatus 1. The material shaping members include a convex material shaping roller 9 over which the material 8 is drawn by the feed rollers 6 and 7. An input opening 10 for the material 8 downstream of the convex roller 9 is defined by first and second pairs of spaced, parallel rollers 11, 12 and 13, 14. The second pair of rollers 13, 14 extend in a direction transverse to that of the first pair of rollers 11, 12. When the material 8 is drawn over the convex roller 9, the lateral edges of the material are directed in a first direction over the convex surface of the roller 9. Continued movement of the material 9 through the input opening 10 directs the lateral edges of the material 8 in a second direction such that the edges are folded back on the material for forming a continuous strip of cushioning product. More particularly, as shown in FIGS. 7A, 7B and 7C, the convex roller 9 and two pairs of rollers 11, 12 and 13, 14 constitute a conversion assembly through which the paper from the roll 5 is pulled by the feed rollers 6 and 7 to fold and form the paper into pillow-like shapes for use as cushioning dunnage, see paper pillow 15 in FIG. 7B.

The compact apparatus 1 further comprises a perforator 16 driven by the motor 3 for perforating paper material 8 at spaced locations 17 along the length of the material as the material is fed through the apparatus. The line of perforations 17 on each side of the material are edge cuts made by cooperating perforation gears 18 and 19 between which the material is fed. The perforation gears 18 and 19 are arranged coaxial with the feed rollers 6 and 7 on each side of the material being fed. When the pillow-like shaped material is dispensed from the compact apparatus 1, an operator can rip from the apparatus a desired length of cushioning product, such as pillow 15 in FIG. 7B, because of the spaced perforations 17 in the material.

An input chute 20 and an output chute 21 of the apparatus 1 guide the material 8 on respective sides of the material feeding arrangement 4. The input and output chutes, convex material shaping roller 9, input rollers 11, 12 and 13, 14 and other components of the apparatus are mounted as a unit on the supporting frame 22 of the apparatus. In the example embodiment, the compact apparatus 1 in the form of a pivotal head which is mounted on the floor stand 2, FIG. 6, for multi-directional pivoting for ease of loading paper material. Different positions for the pivotal head 1 on the floor stand 2 are shown in dashed lines in FIG. 6. It is noted that the size of the input opening 10 delimited by the roller pairs 11, 12 and 13, 14 is small enough to preclude an operator's hand from being inserted through the input opening for operator safety.

Figure 6:
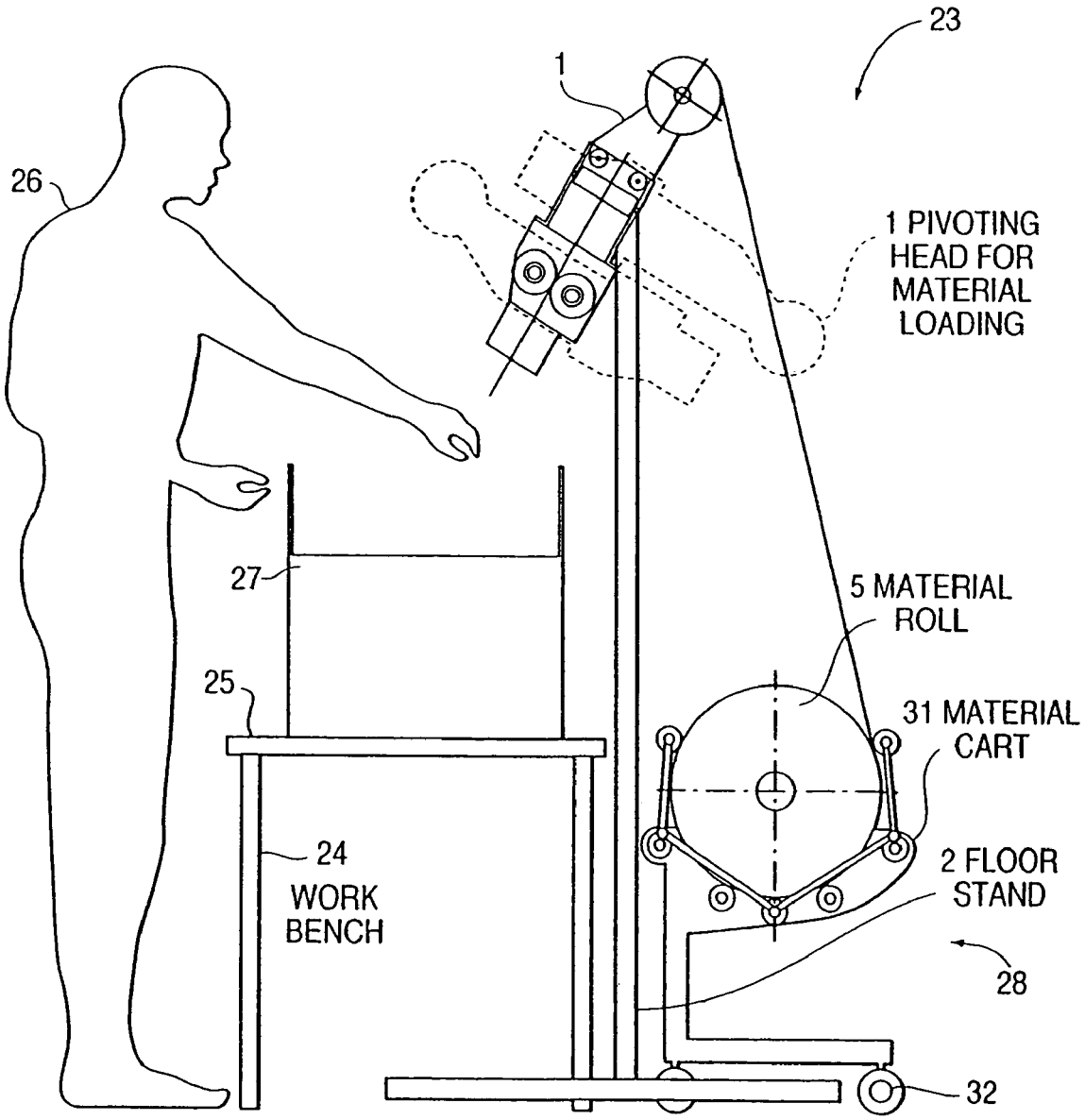
FIG. 6 is a right side view of a first example embodiment of a system of the invention which includes the compact apparatus of FIGS. 1-5 mounted on a floor stand located behind a work bench with a material cart with automatic roll tensioner supporting a material roll supplying paper to the apparatus.

A system 23 of the invention for creating and dispensing material for use as void fill and cushioning dunnage is shown in FIG. 6. The system includes, in combination, the compact apparatus 1 and a stand 2 on which the compact apparatus is mounted. The system 23 further comprises a work bench 24 providing a work surface 25 for an operator 26 for moving pillow-like shaped material 15 from the apparatus 1 and inserting it into the box 27 containing an item to be shipped. The system 23 of FIG. 6 further comprises a roll support 28 which rotatably supports the paper roll 5 from which the material can be unwound by being pulled by the feed rollers 6 and 7 of the compact apparatus 1 for supply to the compact apparatus. The roll support 28 in the system 23 in FIG. 6 is in the form of a material cart 31 with wheels 32.

Figure 8:
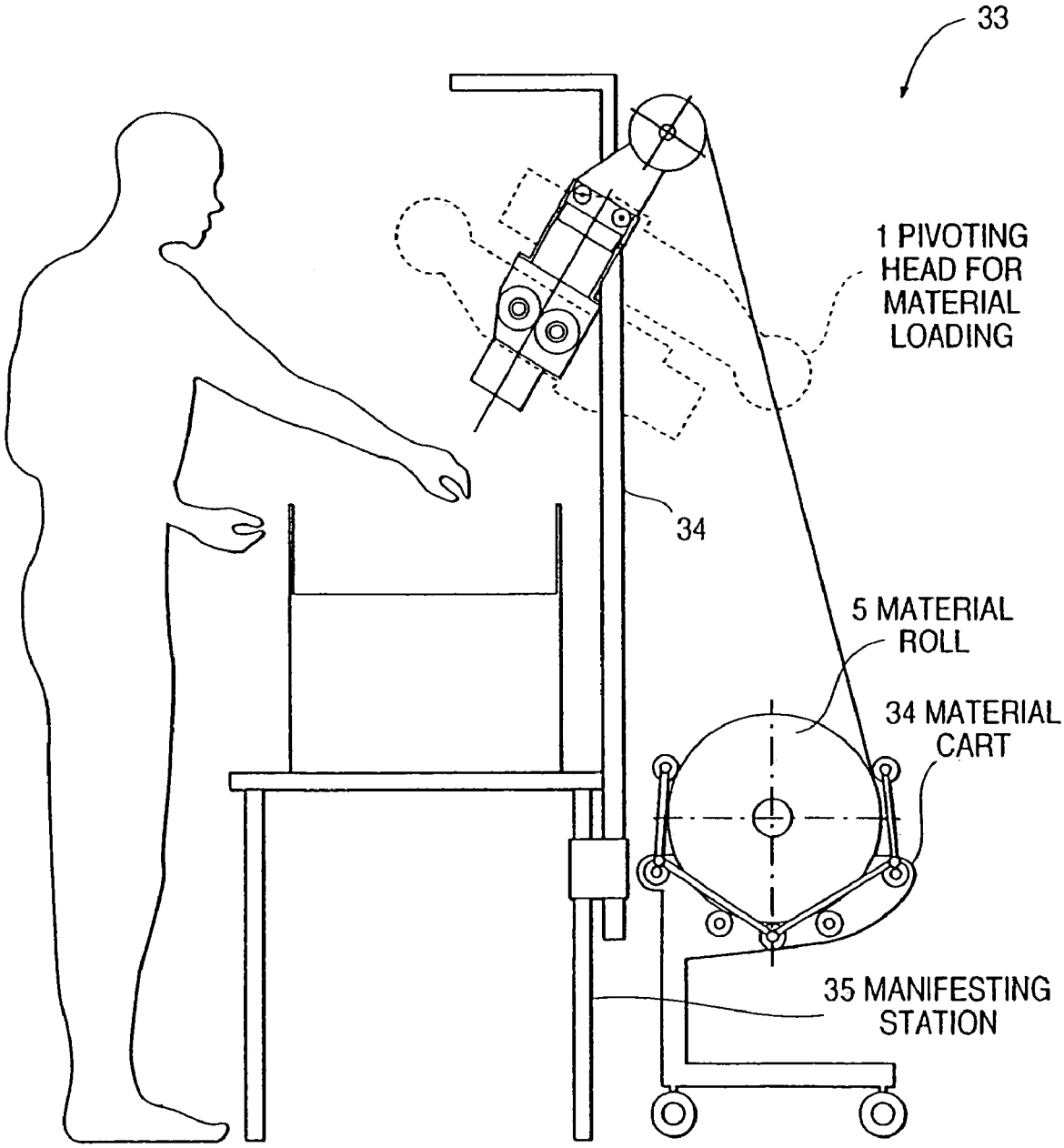
FIG. 8 is a right side view of a second example embodiment of a system according to the invention wherein the compact apparatus is mounted on a manifesting station above a work surface thereof.
Figure 9:
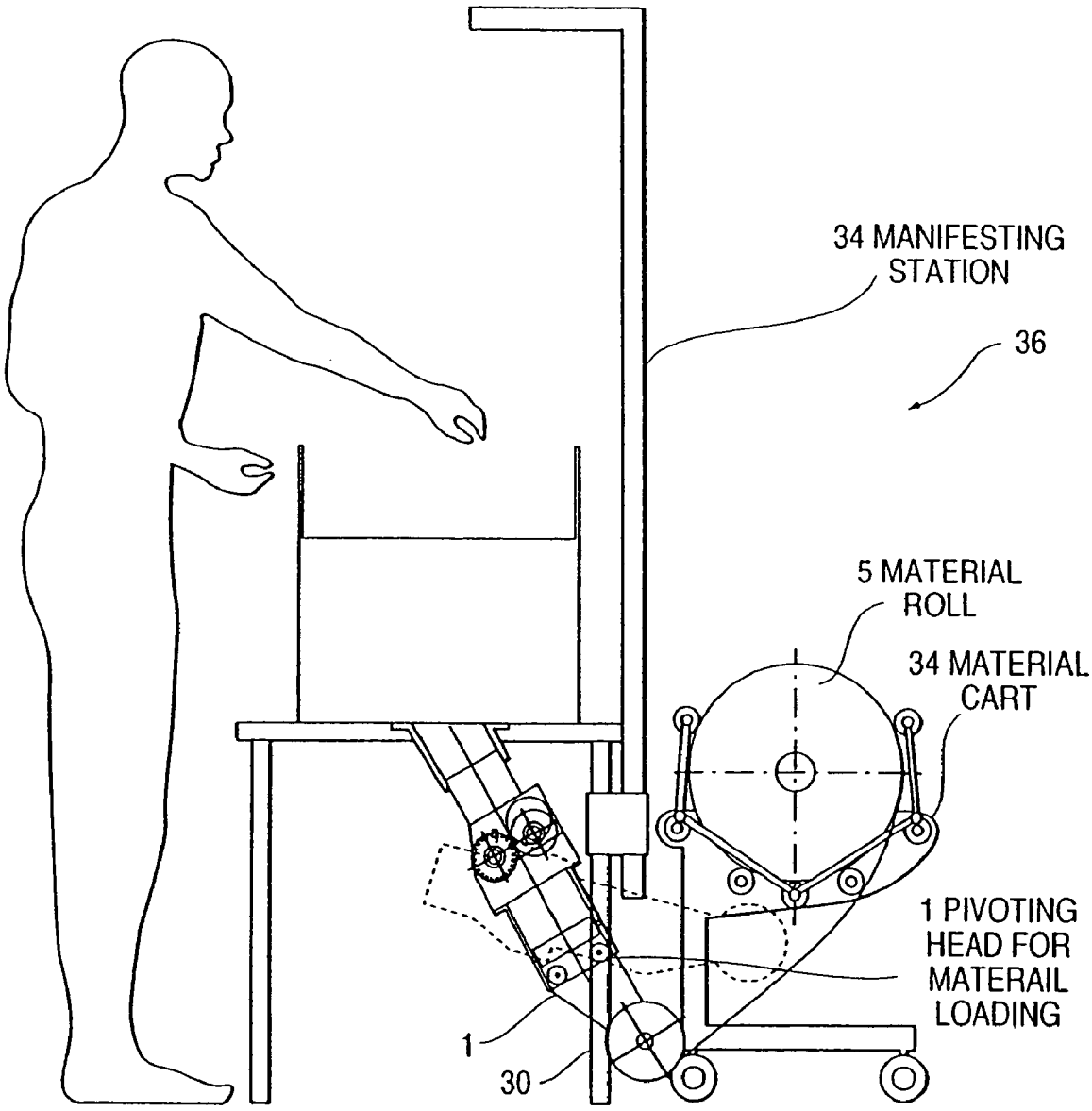
FIG. 9 is a right side view of a third example embodiment of the system of the invention wherein the compact apparatus of the invention is pivotally mounted on a material cart and positioned beneath a work surface of a manifesting station.
Figure 10:
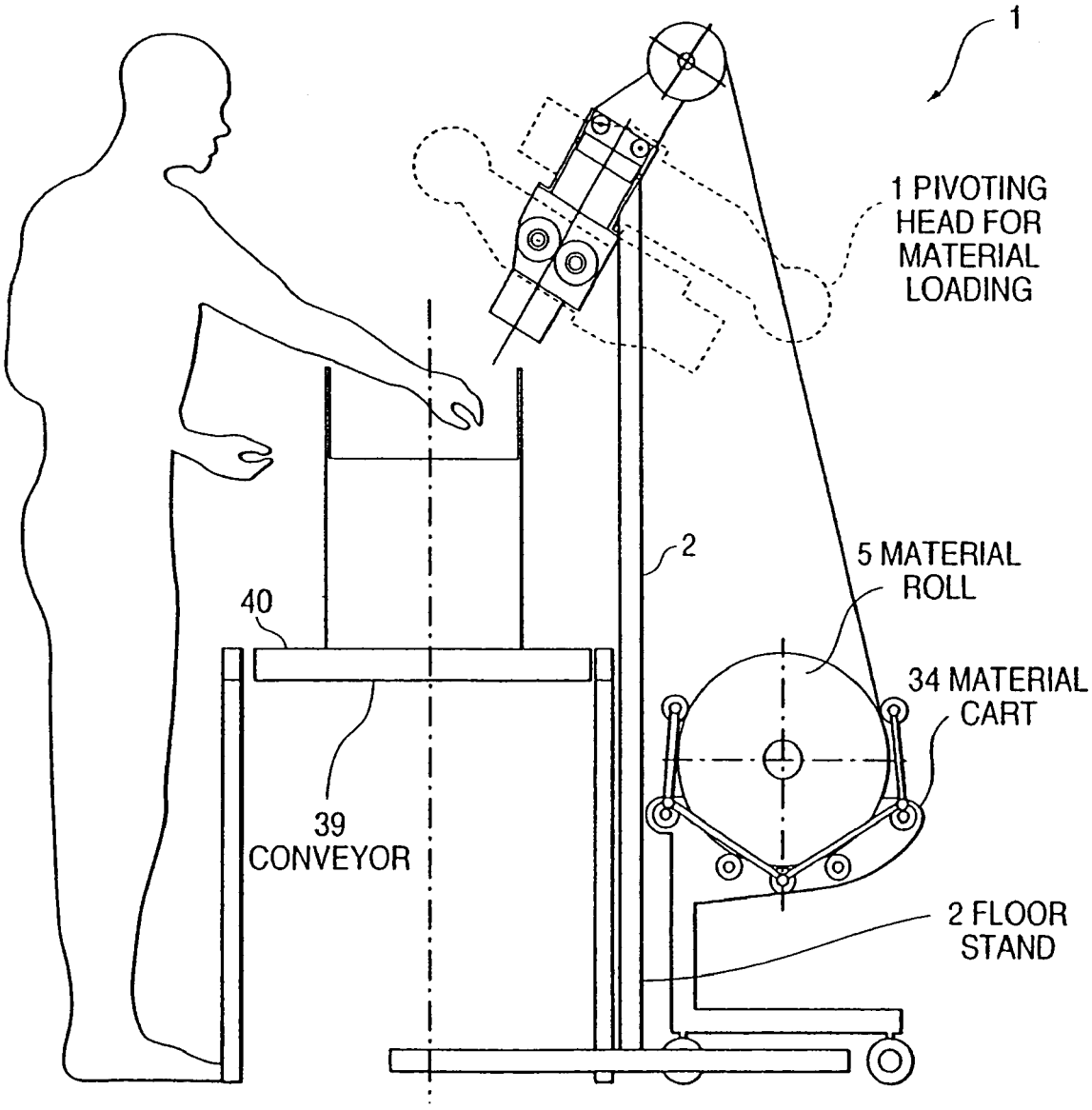
FIG. 10 is a right side view of a fourth example embodiment of the system of the invention having a conveyor providing a work surface in front of a floor stand carrying the compact apparatus of the invention.
Figure 11:
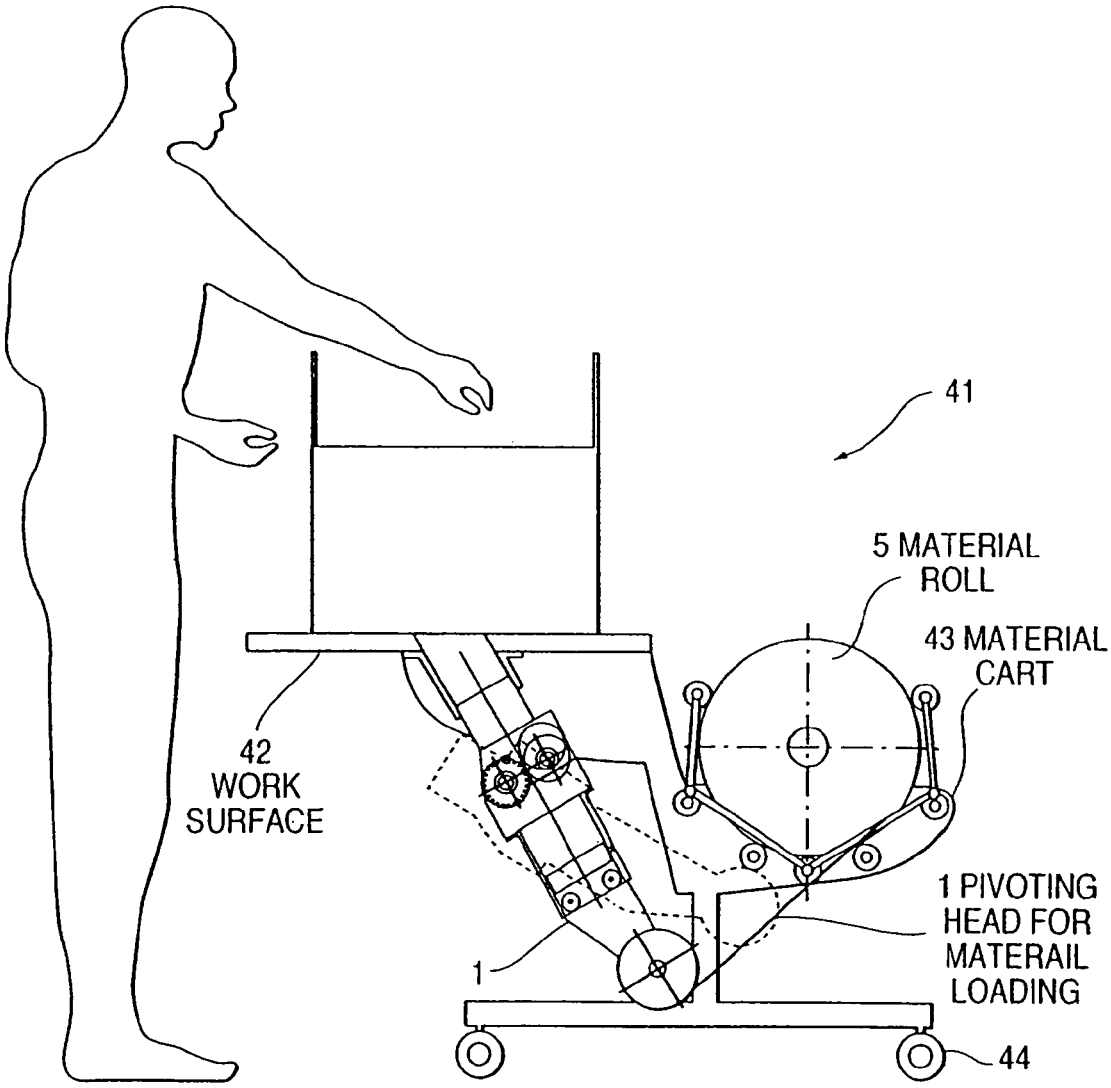
FIG. 11 is a right side view of a fifth example embodiment wherein a material cart of the system includes a work surface and has the compact apparatus pivotally mounted to the cart.

The system 33 in the example embodiment of FIG. 8 comprises a stand 34 supported on a manifesting station 35. The system 36 in FIG. 9 is similar to that in FIG. 8, except that the compact apparatus 1 is pivotally mounted beneath the work surface of the manifesting station on a lower leg 30 of the manifesting station. The system 38 in the example embodiment of FIG. 10 employs a floor stand 2 like that in FIG. 6 with a conveyor 39 being located in front of the compact apparatus to provide a work surface 40. The system 41 of FIG. 11 integrates the work surface 42 with material cart 43. The cart 43 also serves to pivotally mount the compact apparatus 1 beneath the work surface 42. The entire system is portable because of the wheels 44 on the cart 43.

Figure 12:
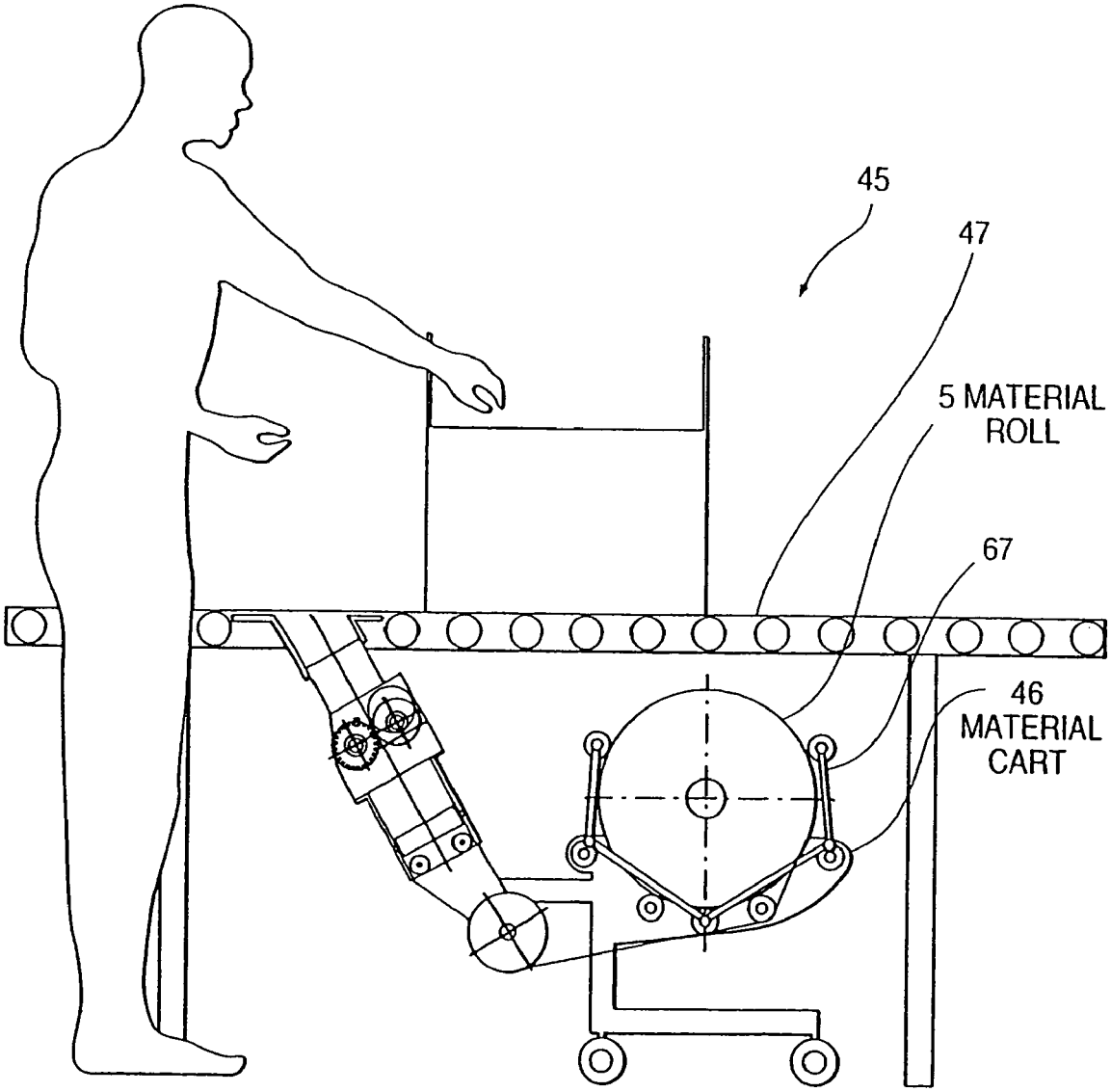
FIG. 12 is a right side view showing a sixth example embodiment wherein the entire material cart with compact apparatus mounted thereon is located beneath a conveyor of the system.
Figure 13:
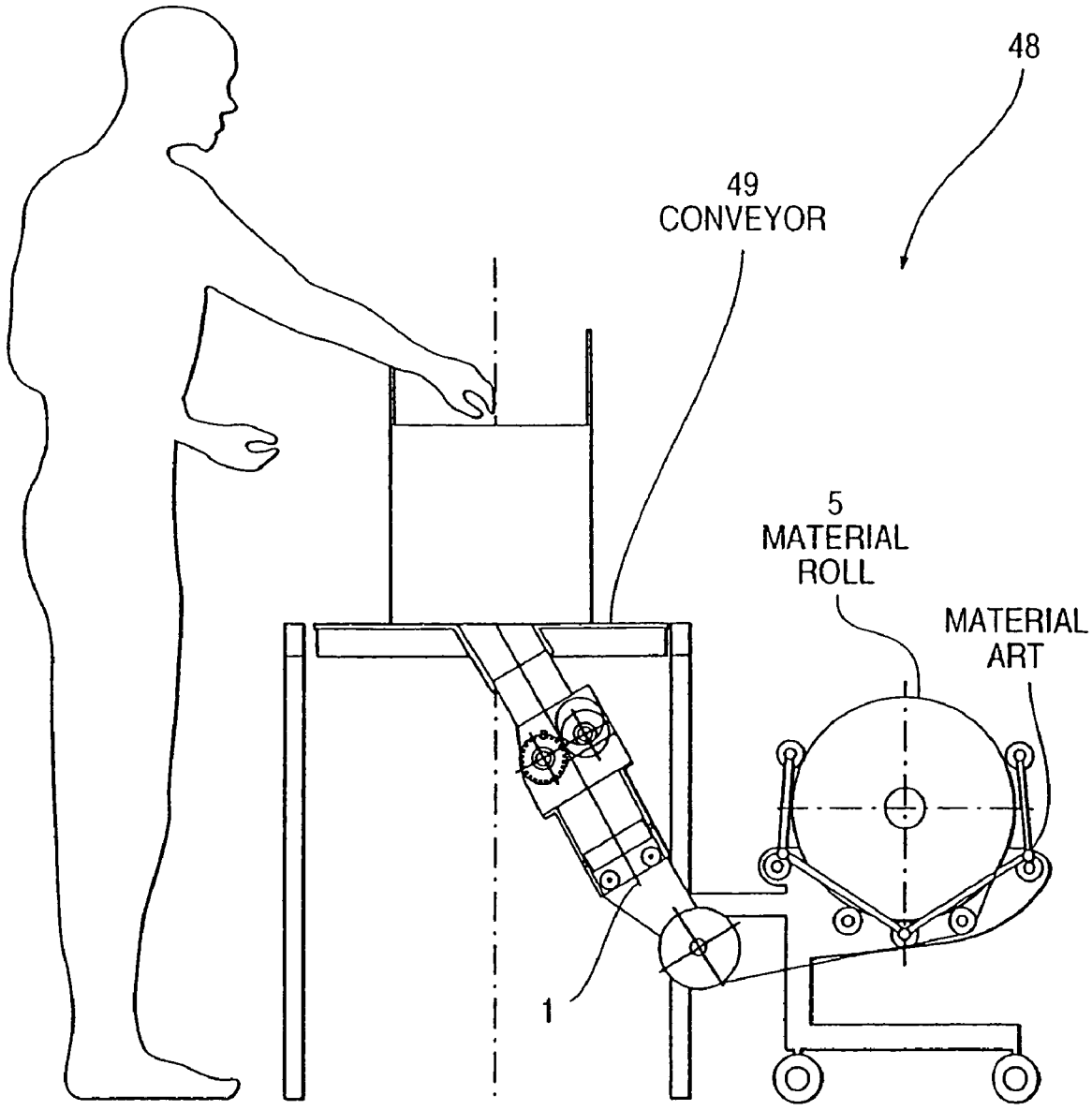
FIG. 13 is a right side view of another example embodiment of the system wherein the material cart is located behind a conveyor and supports the compact apparatus in a position beneath the conveyor.

A system 45 in the example embodiment of FIG. 12 employs a material cart 46 with roll tensioner 67 that pivotally supports the compact apparatus 1 beneath a conveyor 47. The system 48 of FIG. 13 is similar to that in FIG. 12, except that the material cart is located behind the conveyor 49 with only the compact apparatus 1 located beneath the conveyor.

Figure 14:
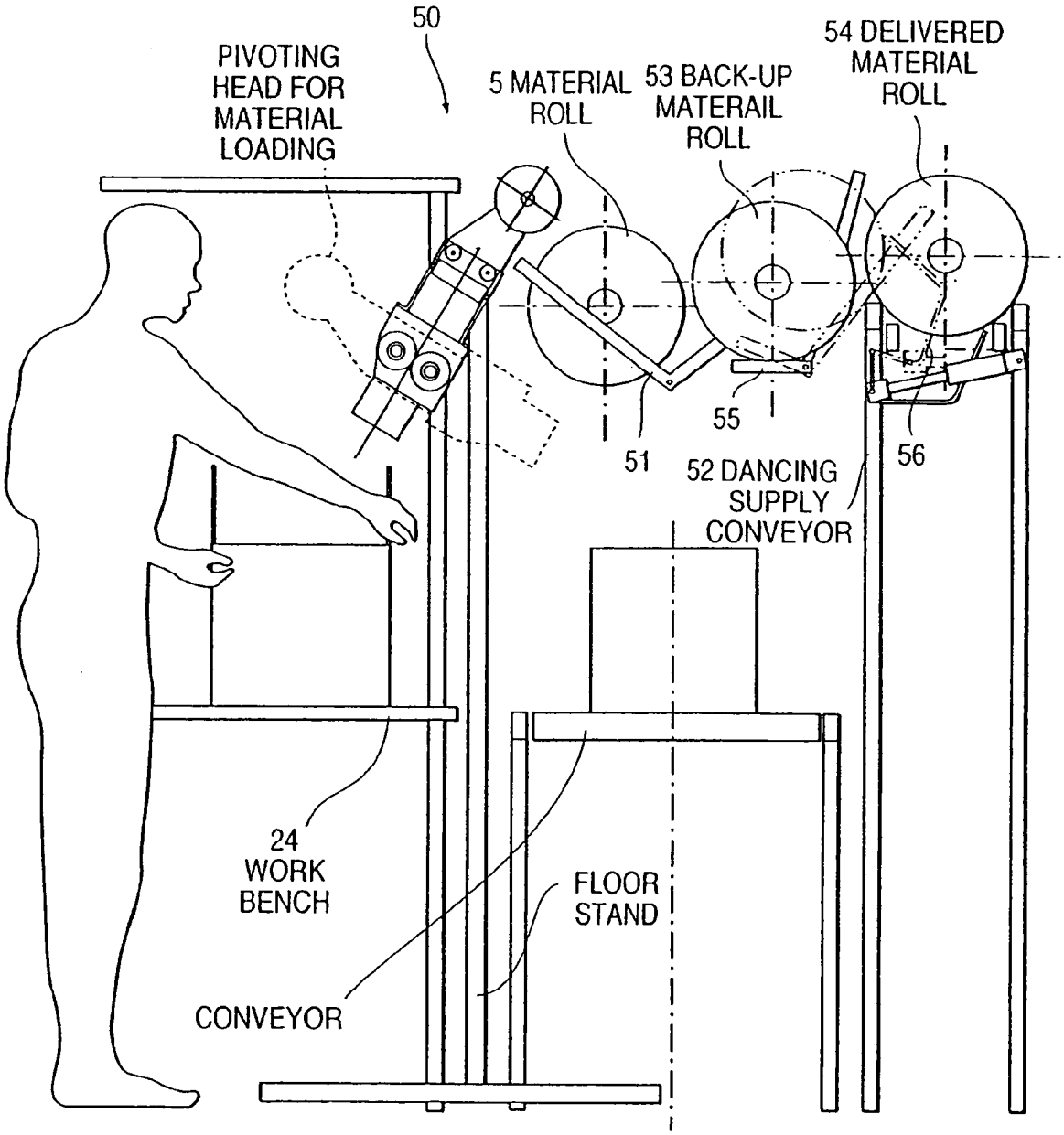
FIG. 14 is a right side view of a further example embodiment of the system depicting an elevated roll delivery arrangement thereof for supplying rolls of material to be used for creating a cushioning product with the system.
Figure 15:
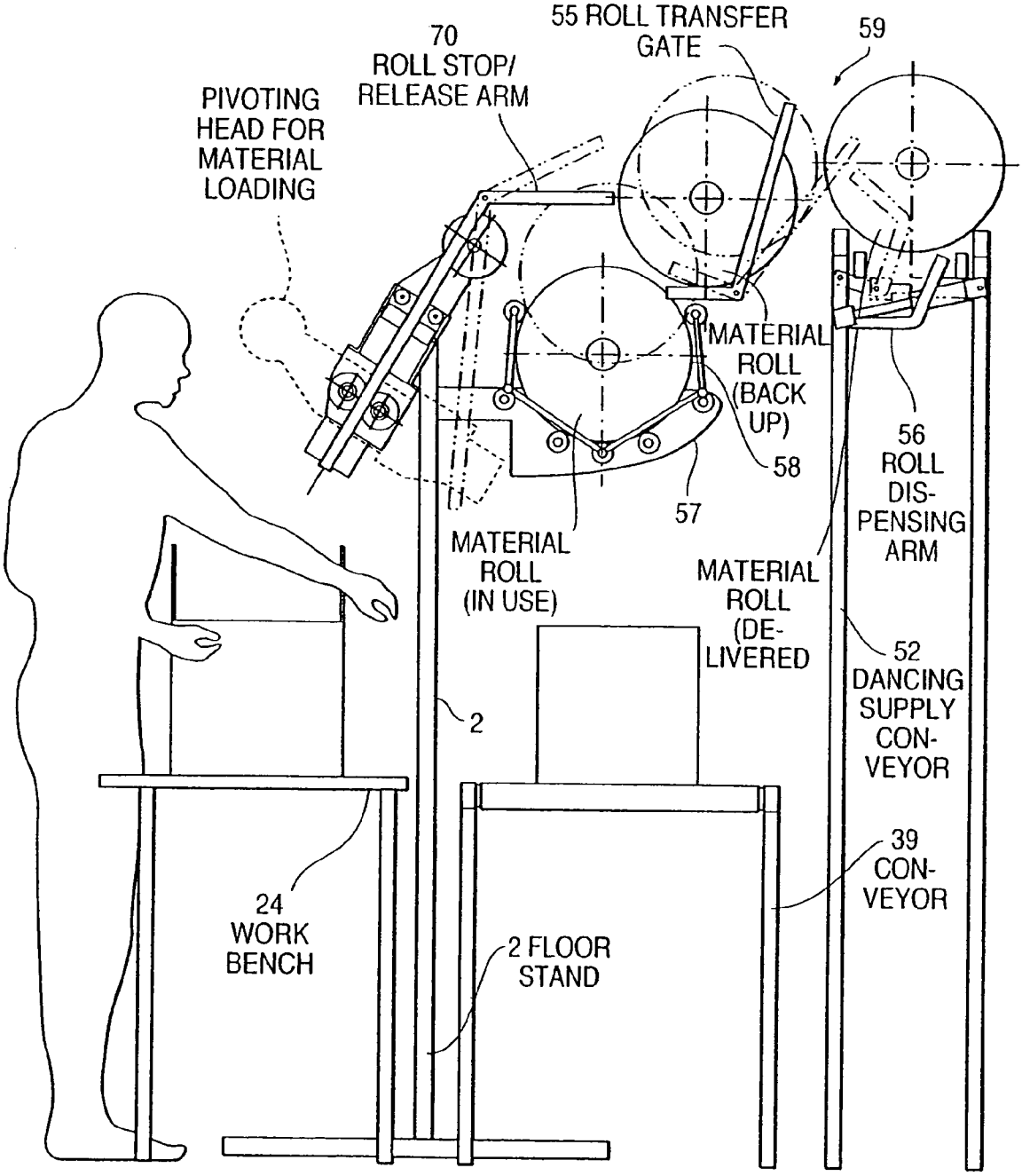
FIG. 15 is a variation of the system according to FIG. 14 schematically showing the use of a roll tensioner as part of the roll support.

A system 50 in FIG. 14 includes an elevated roll support 51 for the material roll 5 with a dancing supply conveyor 52 supplying a back-up material roll 53 for delivery to the roll support 51 to replenish the paper supply as needed. The dancing supply conveyor 52 presents a delivered material roll 54 as depicted in FIG. 14. The delivered material roll 54 is transferred to the position of the back-up material roll 53 by the pivotal transfer arms 55 and 56 shown schematically in FIG. 14. A variation of the system of FIG. 14 is shown in FIG. 15, wherein roll support 57 includes pretensioner 58. The roll support is mounted on the floor stand 2 and the dancing supply conveyor 52 in the system 59 of FIG. 15.

Figure 16A:
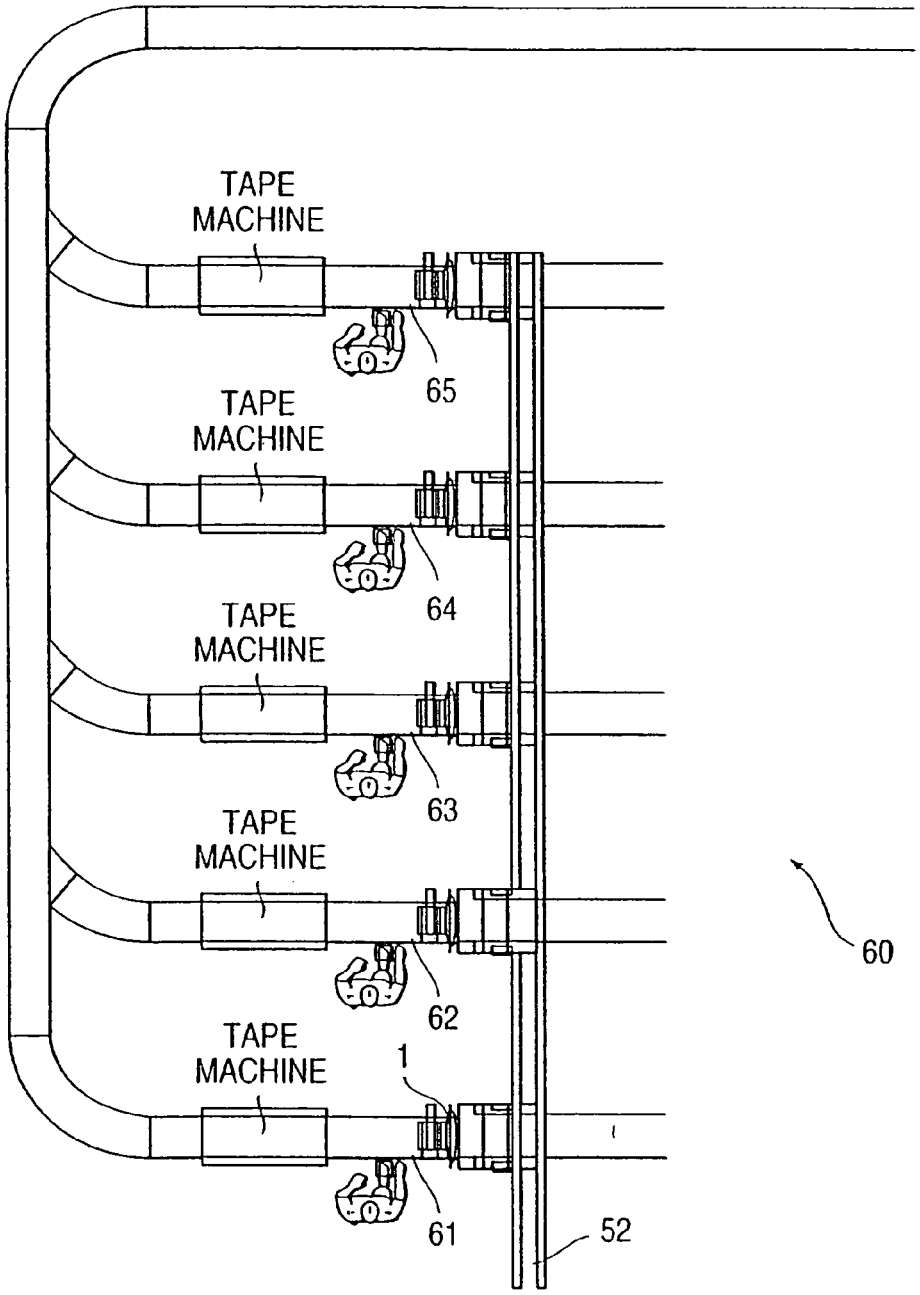
FIG. 16A is a top view of an additional system of the invention wherein an overhead roll delivery arrangement supplies material rolls to a plurality of individual work stations, each having a compact apparatus of the invention.
Figure 16B:
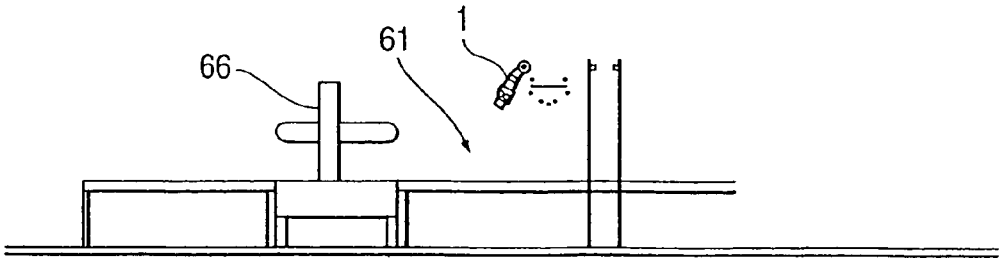
FIG. 16B is a front side view of one work station of the system of FIG. 16A.

The overhead dancing supply conveyor 52 is schematically shown in the system 60 of FIGS. 16A and 16B, wherein the conveyor supplies material rolls to five individual packing stations 61 through 65. Each of the packing stations is provided with a compact apparatus 1 of the invention supported above a work surface for creating and dispensing cushioning dunnage to the operator packing items and containers at the work station. One of the stations, 61, is shown schematically in side view in FIG. 16B. A taping machine is represented at 66.

The operation of the overhead roll-delivery system in FIGS. 14 and 15 will now be described. In a first step, paper rolls move (walk) on the dancing conveyor 52 until a roll-transfer gate, pivotal transfer arm, 55 (closed) stops the roll from moving. When the roll stops moving, the roll-dispensing pivotal transfer arm 56 pushes the roll out of tracks of the dancing conveyor. After the roll is pushed out of the dancing conveyor, the roll will stop against the roll-stop/release arm 70, shown in FIG. 15. As long as a roll stays against the roll-stop/release arm 70, the roll-transfer gate 55 stays open, allowing rolls of paper to move on the dancing conveyor to the next available station. When a new roll of paper is needed for a dispensing unit, e.g., one of the stations 61-65, for example, the operator uses the roll-stop/release arm 70 to release the stand-by roll so that the paper roll can fall into the auto-roll tensioning device 58 as shown in FIG. 15. At this point, the roll is ready to be used. After a roll falls into the auto-roll tensioning device, the roll-transfer gate 55 closes.

In the example embodiments, the paper material preferably has an initial width of 24 to 34 inches. After the edges are folded by the conversion assembly of the apparatus, the width of the pillow-shaped product is reduced to 7-8 inches, for example, with the continuous strip being perforated at 17 on each side every 7 inches, for example. The apparatus and dunnage product could, of course, be dimensioned for producing other sizes of cushioning product.

In use, the operator manually feeds the paper or other material from the supply roll 5 located in the vicinity of the compact apparatus 1 by pressing a feed switch 68 on controller 69, FIG. 1, until the paper extends from exit chute 21 at the front of the unit 1. The operator presses on a foot switch, not shown, to begin dispensing paper. As paper moves through the inside of the unit 1, the paper is folded and formed into pillow-like shapes for use as cushioning dunnage. The formed material is uniformly perforated on each side edge every 7 inches at 17 in the example embodiment. When a desired length of the cushioning product is reached, the operator releases the foot switch to stop dispensing cushioning product. The operator rips the cushioning product from the unit at a desired perforation line and places the product in the box 27 to use for void-fill or cushioning.

The compact apparatus and system of the invention is advantageously affordable and practical for customers whose packing needs can be met with a single unit that doesn't take up a lot of space. It also can flexibly serve the needs of customers with high-speed and high-volume production lines where multiple, stand alone packing stations such as 61-65 and/or centralized packing stations are utilized. Raised flexible installation configuration options, which can be installed over or under work benches, and over or under conveyor lines, are shown in the several example embodiments. Multi-directional pivoting of the unit 1 on the stand/material cart is for ease of loading the paper material 8 in unit 1. Because perforation is achieved in the paper material on-site and in real-time, pre-perforated paper need not be provided on a roll.

Another embodiment of a compact apparatus 71 of the invention is partially illustrated in FIGS. 17-20D. The apparatus 71 is like that in FIGS. 1-5, and useable in systems as in FIGS. 6 and 8-16B, with the difference that instead of using perforator gears 18 and 19 as in compact apparatus 1, the apparatus 71 comprises cooperating feed rollers 72 and 73 wherein at least one of the feed rollers is a rotary cutting die. In the example embodiment only one of the feed rollers, 72, is a rotary cutting die having a plurality of cutting blades 74 on its surface for cutting slits 86 in material at spaced locations along the length of the material as the material is fed through the apparatus to allow an operator to rip from the apparatus a desired length of cushioning product being dispensed by the apparatus, see the length 75 ripped from the material as shown schematically in FIG. 20D.

The feed roller 73 in the example embodiment has a smooth, annular surface so that it acts as an anvil against which the material being fed between the rollers can be cut by the blades 74 on roller 72. The rollers are driven by motor 76 through transmission 77 under the control of controller 78, the operation of which is like that described in reference to the embodiment of FIGS. 1-5 and the systems of FIGS. 6 and 8-16B. The input rollers 11-14 and material shaping roller 9 shown in FIGS. 1-5 are also used in the compact apparatus 71 although not shown in FIGS. 17-20D for simplicity.

Figure 17:
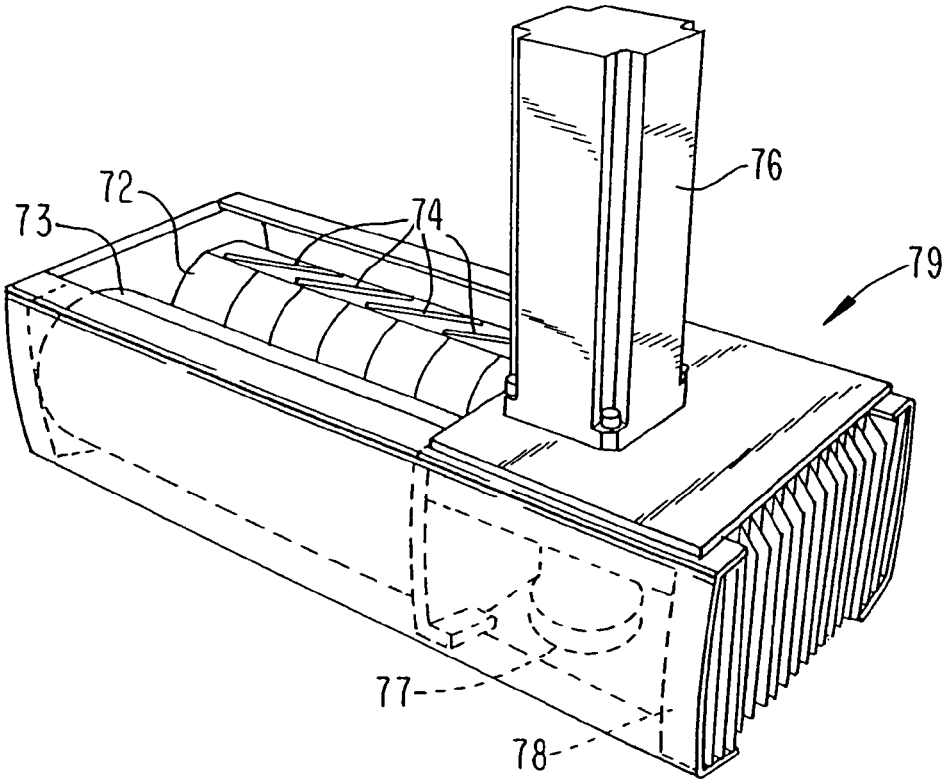
FIG. 17 is a perspective view from the front right and somewhat above a rotary die cut assembly of another embodiment of a compact apparatus of the invention for creating and dispensing material for use as void fill and cushioning dunnage.
Figure 18:
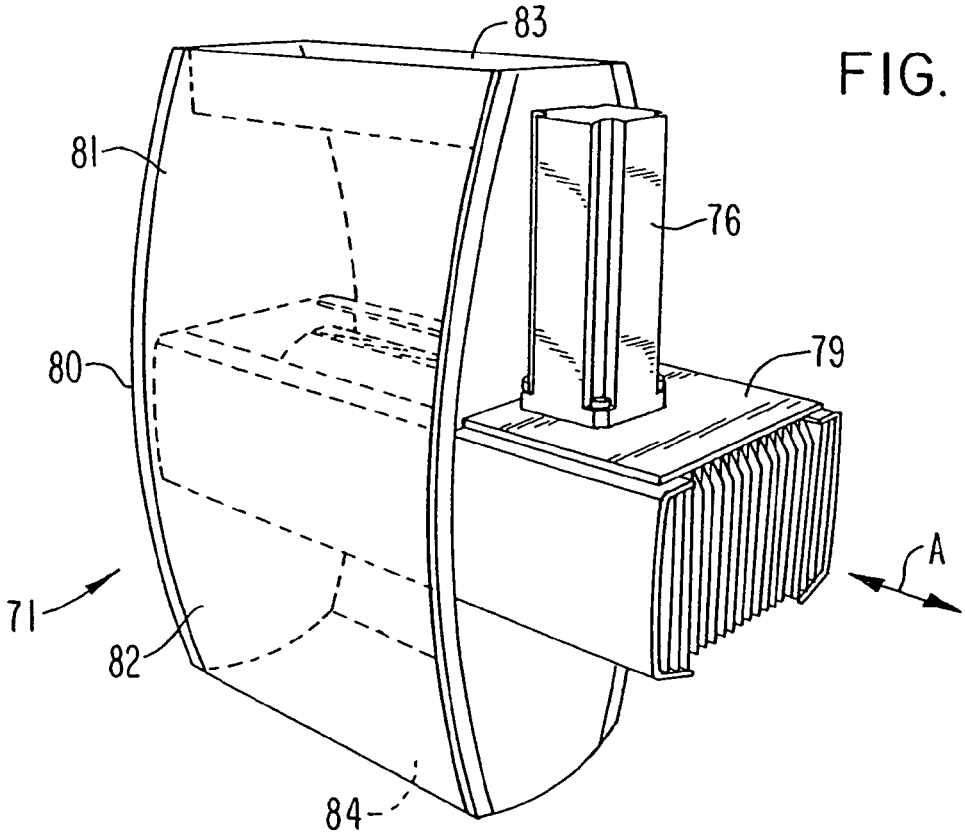
FIG. 18 is a perspective view from the front right of the rotary die cut assembly of FIG. 17 removably installed as a unit in a cavity of a housing of the compact apparatus defining input and output chutes for material fed through the apparatus, the apparatus otherwise being like that shown in FIGS. 1-5, and useable in the systems shown in FIGS. 6 and 8-16B.
Figure 19A:
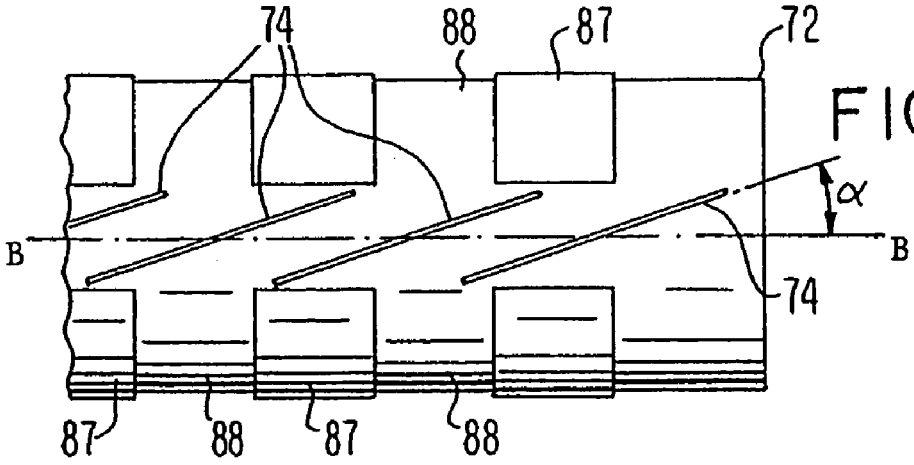
FIG. 19A is a top view of the right side of a feeding roller of the die cut assembly of FIGS. 17 and 18, the feeding roller being a rotary cutting die having a plurality of cutting blades on its surface.
Figure 19B:
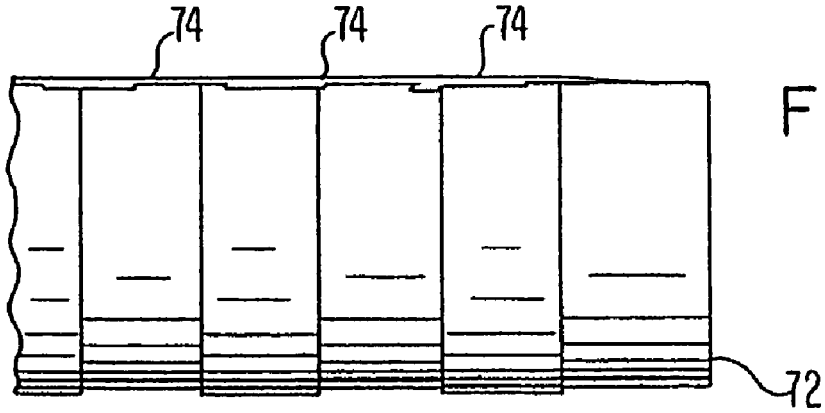
FIG. 19B is a front side view of the feeding roller which also serves as a rotary cutting die as seen from below the roller in FIG. 19A.
Figure 19C:
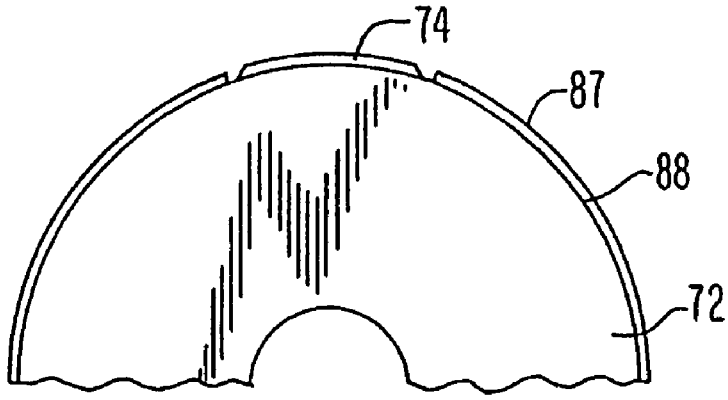
FIG. 19C is a partial end view of the feeding roller/rotary cutting die as seen from the right end of the roller in FIG. 19B.
Figure 20A:
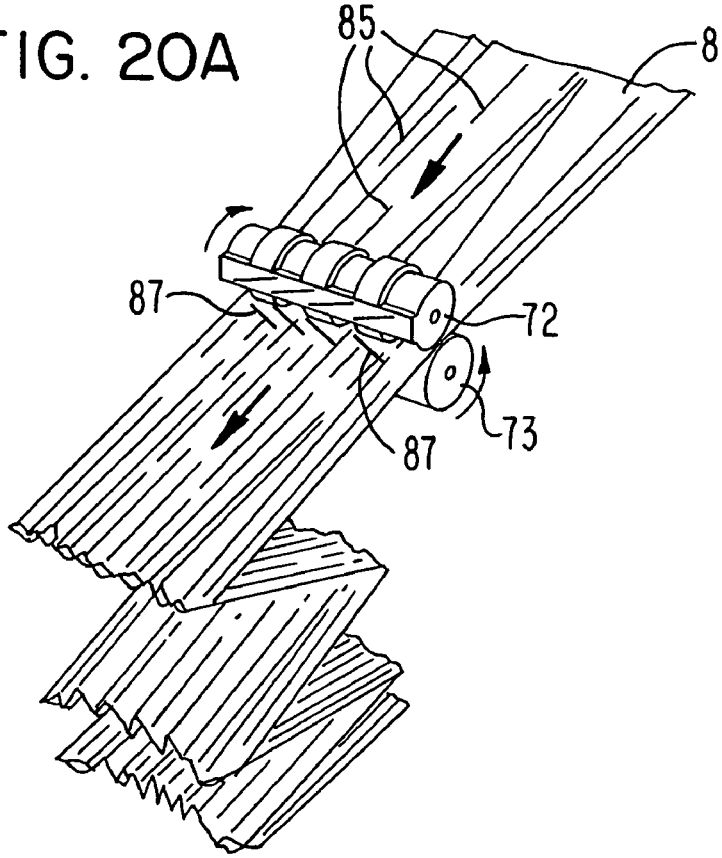
FIG. 20A is a schematic representation in perspective of the feed rollers of the apparatus of FIGS. 17-19C showing the continuous strip of material, shaped with its width reduced to form longitudinally extending convolutions across the width of the material with angled slits formed therein by the rotary cutting die of the material feeding arrangement, the material being folded on itself downstream of the feeding roller by a hinge effect at the spaced locations of the slits along the length of the material.
Figure 20B:
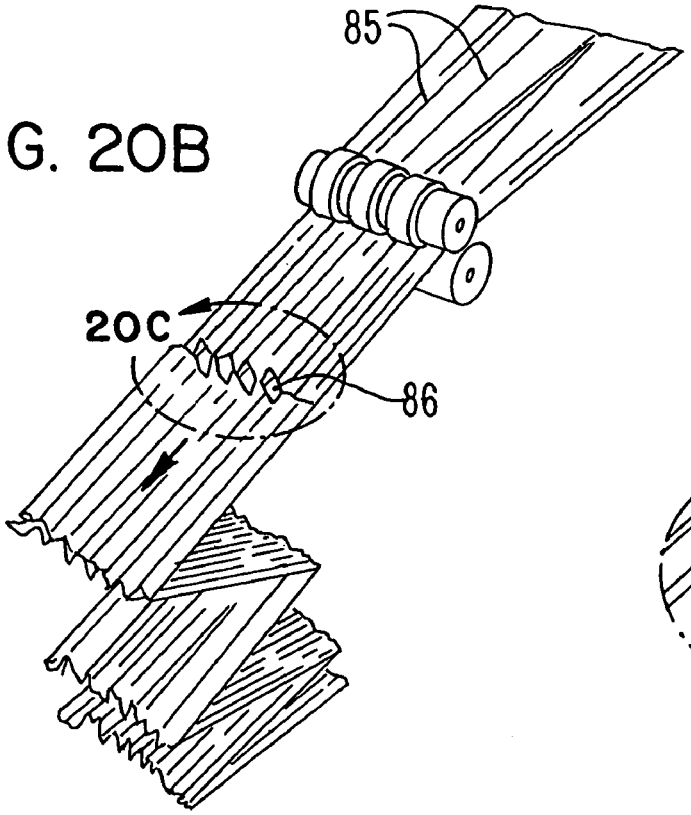
FIG. 20B is a schematic, perspective view similar to FIG. 20A and showing in more detail the opening of the slits through random convolution of the material into an irregular honeycomb-like structure during separation of the material.
Figure 20C:
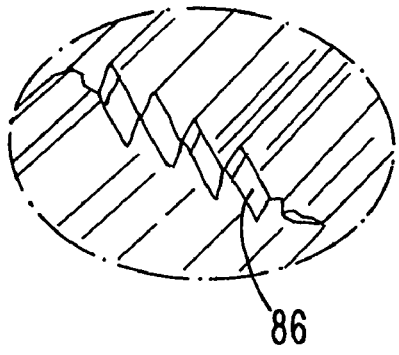
FIG. 20C is an enlarged view of the irregular honeycomb-like structure within the circle 20C in FIG. 20B.
Figure 20D:
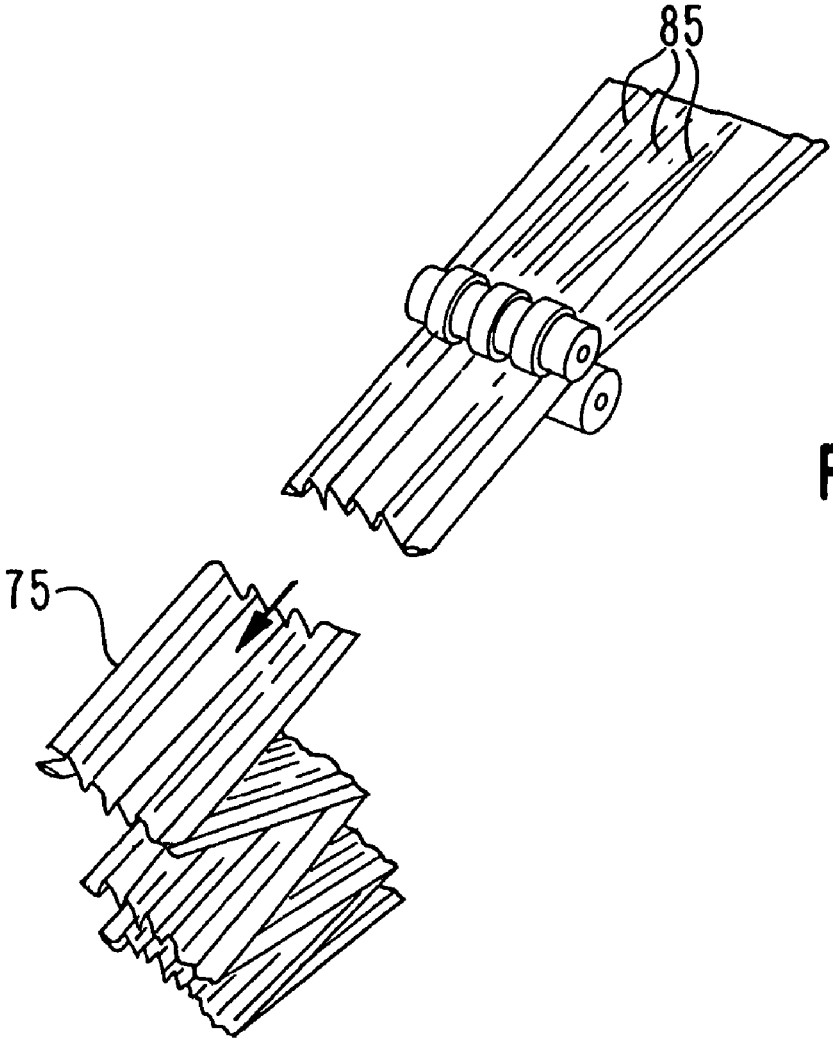
FIG. 20D is another schematic, perspective view like FIGS. 20A and 20B showing a separated length of material ripped from the strip by the operator in the direction of the arrow.

The rotary cutting die assembly, 79 in FIG. 17, is a unit which can be removably installed in the open-ended chute structure 80 of the apparatus 71 in the direction of arrow A as depicted in FIG. 18 from either side of the apparatus. The structure 80 forms input and output chutes 81 and 82, respectively, leading to and from the cooperating feed rollers in the compact apparatus through respective openings 83 and 84. The cutting blades 74 on the rotary cutting die/feed roller 72 are arranged at an angle $\alpha$ to the roller axis B-B as shown in FIG. 19A. The angle $\alpha$ is 18° in the example embodiment, but could be another angle, although preferably a is within the range of 10° and 80° for the reasons discussed below. The blades are embedded in the roller surface with their outer cutting edges protruding from the roller surface and following the roller circumference as seen in FIGS. 19B and 19C. The smoothed surface feed roller 73 in the example embodiment is formed of an ultrahigh molecular weight plastic. The roller has a diameter slightly different from roller 72 for even wear. The material 8 fed between the rollers 72 and 73 is pinched between the opposed surface of the rotatably driven rollers for feeding and cutting slits in the material.

The plurality of shaping rollers upstream of the rotary cutting die assembly 79 are preferably dimensioned and adjusted to reduce the width of the material so that random convolutions 85 are formed in the material across the width of the material. This is done without folding back the edges of the material as in the product of FIGS. 7A-7C. The rollers are rotatably mounted so as to move with the contacting strip of material thereby minimizing sliding contact and friction. The material, including these convolutions are slit by the rotary cutting die. This feature, together with the angle of slits 86 cut into the material convolutions, results in a cushioning product in which separation of the material starts with the expansion of the slits through the random convolutions of the paper or other material into an irregular honeycomb-like structure 86, see FIGS. 20B and 20C. Separation of the material is completed with the fracture of the honeycomb structure to provide a length 75 of the material, FIG. 20D, upon ripping by the operator.

The feed roller/rotary cutting die 72 in the example embodiment has a circumferential surface with annular portions 87 and 88 of relatively larger and relatively smaller diameter spaced along the roller axis B-B. The cutting blades 74 are located intermediate the axial ends of the roller and circumferentially between the opposite ends of the relatively larger diameter annular portions 87 as seen in FIG. 19A. The void fill and cushioning dunnage produced by the compact apparatus 71 advantageously exhibits a hinge effect at each slit area along its length as it is fed from the apparatus so that the material readily folds on itself during dispensing as shown at 87 in FIGS. 20A-20C. It has been found that this helps rapidly fill voids in packages with little effort by the operator once the filling process is started. The slits also enable quick ripping of a length of the material from the continuous strip once the package has been filled.

While I have shown and described only several example embodiments in accordance with the present invention, it is understood that various changes and modifications can be made therein by the skilled artisan without departing from the invention. Therefore, I do not wish to be limited to specific example embodiments disclosed herein, but intend to cover such variations as are encompassed by the scope of the appended claims.

I claim:

1. A compact apparatus for creating and dispensing material for use as void fill and cushioning dunnage, the apparatus being capable of being mounted as a unit on a stand and comprising:

a die cut assembly constructed as a unit for installation and removal from the apparatus, the die cut assembly including a motor and a material feeding arrangement driven by said motor, said material feeding arrangement including cooperating feed rollers for pulling material from a supply of material and feeding it through said apparatus;

wherein at least one of said feed rollers is a rotary cutting die having a plurality of blades on its surface for cutting slits in the material at spaced locations along the length of said material as the material is fed through the assembly;

a chute structure forming input and output chutes with respective openings for material fed to and from the apparatus;

wherein the die cut assembly is removably installed as a unit through an opening in a side of the chute structure.

2. The apparatus according to claim 1, wherein the chute structure is open-sided to permit the die cut assembly unit to be removably mounted in the chute structure from either side of the chute structure.

* * * * *